United States Patent [19]

Sedam

[11] 4,357,284

[45] Nov. 2, 1982

[54] $CO_2$ SUPPLY SYSTEM FOR A CARBONATOR DEVICE

[75] Inventor: Jason K. Sedam, Dunwoody, Ga.

[73] Assignee: Coca Cola Company, Atlanta, Ga.

[21] Appl. No.: 277,806

[22] Filed: Jun. 26, 1981

[51] Int. Cl.[3] ..... B01F 3/04

[52] U.S. Cl. ..... 261/121 R; 99/275; 99/323.1; 137/44; 222/162; 261/64 B; 261/DIG. 7

[58] Field of Search ..... 261/121 R, 64 R, DIG. 7, 261/64 B; 222/162, 509, 518; 426/477, 474; 99/323.1, 275; 137/109, 38, 44

[56] References Cited

U.S. PATENT DOCUMENTS

| | | | |
|---|---|---|---|
| 967,286 | 8/1910 | Young | 261/DIG. 7 |
| 1,243,068 | 10/1917 | Humphrey | 261/DIG. 7 |
| 1,655,816 | 1/1968 | Josephson | 261/121 R |
| 2,160,501 | 5/1939 | Hedges et al. | 261/DIG. 7 |
| 2,805,846 | 9/1957 | Dewan | 261/DIG. 7 |
| 3,003,325 | 10/1961 | Poethig et al. | 137/109 X |
| 3,052,377 | 9/1962 | Bill | 261/DIG. 7 |
| 3,081,004 | 3/1963 | Laughlin et al. | 222/162 X |
| 3,225,965 | 12/1965 | Jacobs et al. | 261/DIG. 7 |
| 3,351,239 | 11/1967 | Flock | 222/162 X |
| 3,572,550 | 3/1971 | Colomina et al. | 261/DIG. 7 |
| 3,967,633 | 7/1976 | Hallanger et al. | 137/44 X |
| 4,093,681 | 6/1978 | Castillo et al. | 261/DIG. 7 |
| 4,222,972 | 9/1980 | Caldwell | 261/121 R |

FOREIGN PATENT DOCUMENTS

| | | | |
|---|---|---|---|
| 397752 | 5/1909 | France | 261/DIG. 7 |

*Primary Examiner*—Richard L. Chiesa

*Attorney, Agent, or Firm*—Birch, Stewart, Kolasch & Birch

[57] ABSTRACT

A $CO_2$ supply system for a carbonator includes a $CO_2$ cylinder containing a combination of liquid carbon dioxide and gaseous carbon dioxide under pressure at approximately 900 p.s.i.g., an openable end including a valve element disposed in an elongated extension of that end, an adaptor socket for receiving the elongated extension and supporting the cylinder, a pressure regulator connected to the adaptor and a hose coupling the same to a carbonator tank and an elongated tube extending from the open end of the cylinder toward a closed end thereof and terminating at a position spaced from the closed end. The elongated tube is open at both ends to permit the flow of liquid or gas therethrough, depending on the orientation of the $CO_2$ cylinder. In order to dispense $CO_2$ gas to a carbonator, the $CO_2$ cylinder is disposed with its open end down and plugged into the adaptor socket. In this position, $CO_2$ gas is present in the head space of the $CO_2$ cylinder adjacent the closed end thereof. Accordingly, this $CO_2$ gas will flow through the elongated tube out through the open end of the container and the pressure regulator to the carbonator tank. However, if the $CO_2$ cylinder is inverted with the closed end on the bottom and the open end on the top, the liquid and gaseous phases within the cylinder will be reversed, permitting only liquid to be dispensed from the $CO_2$ cylinder. Thus, the $CO_2$ cylinder of the present invention will operate satisfactorily to dispense $CO_2$ gas only with the open end on the bottom and plugged into the adaptor socket.

3 Claims, 1 Drawing Figure

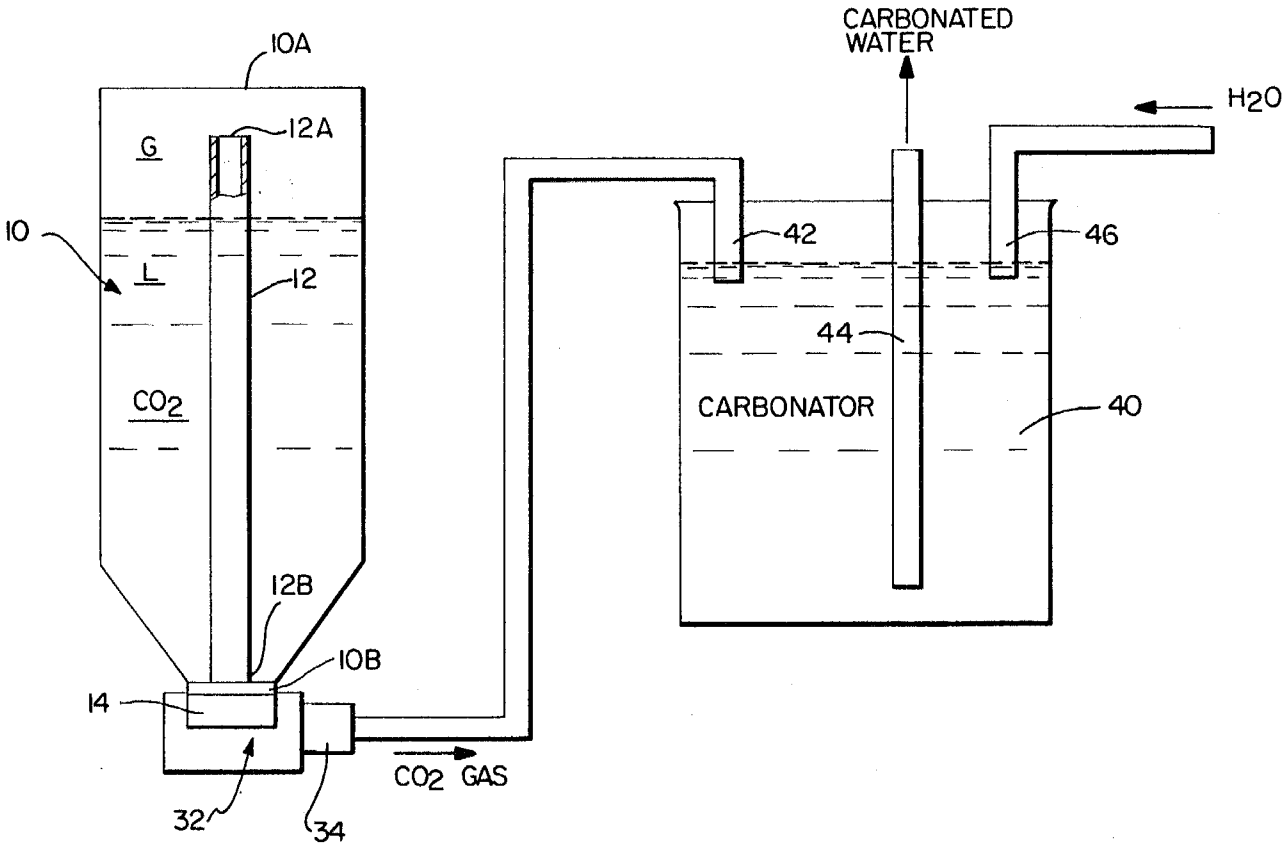
H2O
CARBONATED WATER
46
40
44
42
CARBONATOR
CO2 GAS
10A
12A
12
10B
12B
34
32
G
L
CO2
14
10

$CO_2$ SUPPLY SYSTEM FOR A CARBONATOR DEVICE

BACKGROUND OF THE INVENTION

1. Field of the Invention

The present invention relates to a $CO_2$ supply system for a carbonator device in a Post-Mix beverage dispensing system. More specifically, the present invention relates to a system, device and method for selectively dispensing a gaseous phase from a container separate from a liquid phase contained therein with the container inverted so that an open end thereof is disposed on the bottom rather than on the top, as is conventional in $CO_2$ dispensing systems.

2. Description of the Prior Art

In conventional $CO_2$ supply systems for carbonators or the like or other gaseous supply systems for dispensing gas from a pressurized supply tank, the tanks have a typical rounded bottle-like shape with an open end defined by a neck portion and an opposite closed end on which the container is supported during use. The open end in the neck portion is usually provided with a plug including a valve member and a threaded connection to which a dispensing hose and coupling are attached. In use, these prior art containers require a separate support surface on which the bottom of the container rests and usually threaded connections between the valve member in the open end of the tank and a pressure regulator and dispensing hose. Because of the need for a separate support surface and threaded connections, these containers occupy more room than is often desirable, and the nature of the threaded connection makes it difficult to quickly connect and disconnect the container from the pressure regulator and supply hose. In addition, because of the conventional threaded couplings that are used, it is often required to tighten the connection with a wrench, and to provide a special sealing means between the threads to preclude leakage of the gas being dispensed.

Accordingly, a need in the art exists for a simple means for coupling the open end of a pressurized gas cylinder onto a carbonator system to facilitate the quick connection and disconnection of the same into and out of the system and also to securely support the pressurized gas container within a minimum amount of space.

SUMMARY OF THE INVENTION

Accordingly, it is a primary object of the present invention to provide an improved $CO_2$ cylinder and coupling means therefor, wherein the open end thereof may be simply plugged into a supporting adaptor socket associated with a pressure regulator and retained therein by a friction fit, avoiding the need for any threaded connections.

It is a further object of the present invention to provide a $CO_2$ cylinder for the supply system of the present invention which may only be utilized to dispense $CO_2$ gas with the open end of the cylinder disposed on the bottom and plugged into an adaptor socket.

It is still another object of the present invention to provide a special dispensing means within the cylinder which selectively extracts the gaseous phase from the liquid phase within the cylinder or vice-versa, depending on the orientation of the container.

It is yet another object of the present invention to provide a $CO_2$ cylinder construction which will preclude the continuous flow of liquid from the container into the associated pressure regulator, causing freeze-up of the same.

It is still a further object of the present invention to provide a $CO_2$ cylinder construction and adaptor socket therefor which totally supports the weight of the $CO_2$ cylinder, the connection between the cylinder and the adaptor being sustained solely by the weight of the cylinder in combination with means within the adaptor for resiliently engaging the same.

These and other objects of the present invention are fulfilled by providing a $CO_2$ cylinder, including an open end defined by a narrow neck portion and a closed end, an elongated tube extending from within the open end to a point spaced from the closed end, a pressurized liquid phase in the container, a pressurized gaseous phase in the container, a plug-shaped extension disposed within the open end of the container supporting the elongated tube at one end and a valve member at the opposite end, and an adaptor socket for receiving the plug-shaped extension as the same is plugged into the adaptor socket.

The adaptor socket is in turn connected to a suitable pressure regulator of a conventional type which is coupled to a $CO_2$ gas supply hose leading to a carbonator tank.

Part of the present invention resides in the discovery that a conventional $CO_2$ cylinder containing both a liquid and gaseous phase cannot be inverted as done in the system of the present invention and successfully dispense gaseous $CO_2$ through the pressure regulator to the carbonator tank without providing an elongated tube within the $CO_2$ cylinder. This tube extends from the open end of the cylinder to a point spaced from the closed end of the cylinder, in communication with the gaseous phase within the cylinder disposed in the head space thereof. Because of the presence of this tube, the gaseous material, namely, the $CO_2$ gas in the head space of the container, flows down the tube, out through the valve means in the plug-shaped extension, and into the pressure regulator on route to the carbonator tank. Without the presence of this elongated tube, only liquid $CO_2$ would be continuously dispensed out of the cylinder, which, of course, is undesirable and also results in freeze-ups of the pressure regulator.

On the other hand, if the $CO_2$ cylinder of the present invention is disposed in a conventional manner with its closed end on the bottom and its open end at the top, only liquid carbon dioxide can be dispensed from the container since the liquid and gaseous phases are now reversed, the liquid being adjacent the closed end and the gas being adjacent the open end. Accordingly, the $CO_2$ cylinder of the present invention cannot be used in conventional $CO_2$ gas supply systems.

It should be noted that conventional $CO_2$ cylinders, as well as the cylinder for use in the system of the present invention, contain both liquid $CO_2$ and gaseous $CO_2$ under a pressure of about 900 p.s.i.g. These containers are never completely filled with liquid, but contain both a liquid and gaseous phase. Of course, as part of the gaseous phase is removed, the space that it occupied is replenished with gas as the liquid phase changes to the gaseous phase within the container.

BRIEF DESCRIPTION OF THE DRAWINGS

The objects and many of the attendant advantages of the present invention will be readily appreciated as the same becomes better understood by reference to the following detailed description, when considered in conjunction with the accompanying drawings, in which like reference numerals designate like parts throughout the figure thereof, and wherein:

The sole FIGURE is a diagrammatic view of the $CO_2$ system of the present invention, illustrating how it is connected to a conventional carbonator device.

DETAILED DESCRIPTION OF THE DRAWINGS

Referring in detail to the drawings, there is illustrated a $CO_2$ cylinder generally indicated 10, which includes both liquid and gaseous $CO_2$ under a pressure of approximately 900 p.s.i.g. The cylinder 10 has an open end 10B defined by a narrow neck portion which is coupled to a plug-shaped extension 14, which plugs into an adaptor socket 32. Adaptor socket 32 supports the entire weight of the cylinder 10 and contains suitable resilient sealing means for sealing plug-shaped extension 14 therein. Plug-shaped extension 14 also contains a valve therein which opens in response to the insertion of cylinder 10 into socket 32, providing a fluid path from cylinder 10 to a pressure regulator 34. Pressure regulator 34 is connected to the adaptor 32 and also to a $CO_2$ gas dispensing hose 42 running from the regulator to a carbonator tank 40. The carbonator tank may be of any conventional variety, and, of course, also includes a water inlet tube 46 and a carbonator water outlet tube 44.

The $CO_2$ cylinder 10 contains both a liquid phase L and a gaseous phase G which, because of their differences in weight, occupy different portions of the cylinder 10. That is, the gaseous phase G is at the top of the container, as illustrated adjacent the closed end 10A of the cylinder and the liquid phase L is disposed at the bottom thereof adjacent the open end 10B of the cylinder. An elongated tube 12, open at both ends 12A and 12B, is disposed within the cylinder, end 12B being supported within a socket of plug-shaped extension 14 and end 12A being disposed in spaced relation to the closed end 10A of the cylinder in communication with the gaseous phase G of the material therein. Extension 14 is inserted in the open end 10B of cylinder 10.

DESCRIPTION OF OPERATION

In operation, the $CO_2$ cylinders of the present invention may be quickly inserted and removed from the adaptor socket 32 simply by plugging them into or withdrawing them from adaptor socket 32. Because of the presence of elongated tube 12 within the interior of cylinder 10, the gaseous $CO_2$ in the head space adjacent closed end 10A of the cylinder, can be withdrawn through the tube, through the valve and into the pressure regulator as soon as the valve is opened by the insertion of the cylinder into the socket 32.

As stated hereinbefore, if the cylinder 10 is inverted from the positions illustrated in the drawing, the liquid phase will move to the closed end of the container adjacent the open end of elongated tube 12 and only liquid can be withdrawn through the tube 12.

Thus, it can be seen, because of the novel construction of the $CO_2$ cylinder of the present invention, including the elongated tube 12, that $CO_2$ supply cylinders may be quickly and efficiently replaced without the need for any threaded connections or special tools. Thus, when a particular $CO_2$ cylinder 10 becomes empty and needs replacement, an operator may simply pick up another cylinder and plug it into adaptor socket 32, which provides an instantaneous connection to the pressure regulator and carbonator tank.

It should be understood that the pressurized gas supply system of the present invention may be utilized in combination with devices other than carbonators if desired, for example, a propane tank coupled to a gas burner, furnace or other type of device which utilizes propane for fuel.

The present invention having been thus described, it should be apparent that modifications could be made to the various components of the system, as would occur to one of ordinary skill in the art without departing from the spirit and scope of the present invention.

What is claimed is:

1. In a system for carbonating water, including a carbonator tank in which $CO_2$ gas and water are mixed, means for supplying $CO_2$ gas to said carbonator tank, and means for supplying water to said carbonator tank, the improvement comprising:

a container having $CO_2$ therein in both the liquid and gaseous phase, said container having opposed open and closed ends with the open end pointed downwardly, as viewed in a substantially vertical plane;

socket means for receiving the open end of said container and for supporting the weight of said container therein;

a dispensing outlet in operative association with said socket for supplying the gaseous phase of $CO_2$ to said carbonator tank; and elongated tube means extending from said open end of said container to a point spaced from said closed end, said tube means providing a passage through which only the gaseous phase of $CO_2$ in a region adjacent said closed end may be selectively dispensed from said container to said carbonator tank, separate from the liquid phase therebelow.

2. The system of claim 1, further including pressure regulator means disposed between said dispensing outlet and said carbonator tank for controlling the pressure of said $CO_2$ gas supplied to said tank.

3. In a system for dispensing gas from a container having a fluid therein under pressure, said fluid including both a liquid and gaseous phase, said container having opposed open and closed ends, the improvement comprising:

socket means for receiving the open end of said container and for supporting the weight of said container therein so that said open end points downwardly as viewed in a substantially vertical plane;

a dispensing outlet in operative association with said socket;

elongated tube means extending from said open end of said container to a point spaced from said closed end, said tube means providing a passage through which only the gaseous phase of fluid adjacent said closed end may be selectively dispensed from said container separate from the liquid phase therebelow through said dispensing outlet; and pressure regulator means connected to said dispensing outlet for controlling the pressure of the gas dispensed.

* * * * *